US006912958B2

(12) United States Patent
Marietta

(10) Patent No.: US 6,912,958 B2
(45) Date of Patent: Jul. 5, 2005

(54) FIREWORKS ARTILLERY SHELL

(75) Inventor: Michael S. Marietta, Pittsburg, KS (US)

(73) Assignee: Jake's Fireworks, Inc., Pittsburg, KS (US)

( * ) Notice: Subject to any disclaimer, the term of this patent is extended or adjusted under 35 U.S.C. 154(b) by 0 days.

(21) Appl. No.: 10/662,158

(22) Filed: Sep. 12, 2003

(65) Prior Publication Data

US 2005/0066837 A1 Mar. 31, 2005

(51) Int. Cl.[7] ..... F42B 4/26

(52) U.S. Cl. ..... 102/346; 102/347; 102/360

(58) Field of Search ..... 102/346, 347, 102/349, 351–352, 357, 360, 342, 345, 334

(56) References Cited

U.S. PATENT DOCUMENTS

| | | | | | |
|---|---|---|---|---|---|
| 234,132 | A | | 11/1880 | Kyser et al. | |
| 480,012 | A | | 8/1892 | Hand et al. | |
| D25,275 | S | | 3/1896 | Ives | |
| 617,539 | A | * | 1/1899 | Pain | 102/357 |
| 630,477 | A | * | 8/1899 | Behr | 102/346 |
| 926,457 | A | * | 6/1909 | Behr | 102/352 |
| 957,210 | A | * | 5/1910 | Hitt | 102/349 |
| 1,297,898 | A | * | 3/1919 | Pain | 102/351 |
| 1,299,217 | A | * | 4/1919 | Pain | 102/351 |
| 1,567,267 | A | * | 12/1925 | Hitt | 102/349 |
| 1,666,598 | A | | 4/1928 | Hitt | |
| 1,770,921 | A | | 7/1930 | Hitt | |
| 1,773,197 | A | | 8/1930 | Mulcahy | |
| 1,817,503 | A | * | 8/1931 | Anderson | 102/351 |
| 1,861,893 | A | | 6/1932 | Yamagishi | |
| 1,907,863 | A | * | 5/1933 | Pearsall | 102/335 |
| 1,922,081 | A | | 8/1933 | Driggs, Jr. | |
| 1,922,156 | A | * | 8/1933 | Fabrizio | 102/360 |
| 1,972,478 | A | | 9/1934 | Fabrizio | |
| 2,043,268 | A | * | 6/1936 | Skinner | 102/347 |
| 2,103,936 | A | | 12/1937 | Decker | |
| D164,423 | S | | 9/1951 | Howell | |
| 2,821,922 | A | | 2/1958 | Brown et al. | |
| 3,049,080 | A | * | 8/1962 | Schermuly | 102/351 |
| 3,060,854 | A | | 10/1962 | Maretti | |
| 3,145,530 | A | | 8/1964 | Sobey | |
| 3,227,084 | A | | 1/1966 | Stokes et al. | |
| 3,323,456 | A | * | 6/1967 | Rothman | 102/346 |
| 3,349,707 | A | * | 10/1967 | Wortley, Jr. et al. | 102/357 |
| 3,404,782 | A | | 10/1968 | Ray | |
| 3,596,599 | A | * | 8/1971 | Schillreff | 102/357 |
| 3,678,855 | A | | 7/1972 | Semel | |
| 4,052,940 | A | | 10/1977 | Gits et al. | |
| 4,697,518 | A | | 10/1987 | Lau et al. | |
| 4,771,695 | A | | 9/1988 | Simpson | |
| 4,917,015 | A | | 4/1990 | Lowery | |
| 5,025,729 | A | * | 6/1991 | Cameron | 102/351 |
| 5,249,528 | A | | 10/1993 | Lee | |
| 5,339,741 | A | | 8/1994 | Craven et al. | |
| 5,429,053 | A | | 7/1995 | Walker | |

(Continued)

FOREIGN PATENT DOCUMENTS

| | | | | |
|---|---|---|---|---|
| CA | 674645 | * | 11/1963 | 102/346 |
| CA | 887748 | * | 12/1971 | 102/360 |
| DE | 71493 | | 1/1969 | |

*Primary Examiner*—Harvey E. Behrend
(74) *Attorney, Agent, or Firm*—Hovey Williams LLP

(57) ABSTRACT

A fireworks artillery shell for use as a consumer firework which may be propelled by the use of a mortar is provided which includes a casing, a lift charge, an effects charge, a timing fuse and an ignition fuse, and seals. The seals are provided within the casing above and below the effects charge to increase the burst effect of the effects charge. The lift charge is positioned within the casing and below the lower seal, and upon ignition, lifts the fireworks artillery shell into the air. The seals promote a harder break and more explosive effect from the effects charge without interfering with the lifting charge.

5 Claims, 1 Drawing Sheet

U.S. PATENT DOCUMENTS 5,526,750 A 6/1996 Poor et al.
5,567,907 A 10/1996 Westfall
5,623,113 A 4/1997 Valembois
5,627,338 A 5/1997 Poor et al.
5,739,462 A 4/1998 Poor et al.
5,841,061 A 11/1998 Westfall et al.
5,983,801 A 11/1999 Brunn
6,244,185 B1 6/2001 Yip
6,412,416 B1 * 7/2002 Rouse et al. ..... 102/334

* cited by examiner

FIREWORKS ARTILLERY SHELL

BACKGROUND OF THE INVENTION

1. Field of the Invention

This invention relates to a consumer fireworks shell which includes a lifting charge to propel the shell and an effect charge which provides a visual and audible display once the shell has been lifted. More particularly, it is concerned with a shell wherein the effect charge is tightly encased by the use of packing material to increase the explosive effect of the charge.

2. Description of the Prior Art

Fireworks have long provided entertainment to viewers by their colorful displays. As used herein, "fireworks" means "consumer fireworks" as defined in Title 27, Code of Federal Regulations, Section 55.11, as small fireworks devices designed to produce visible effects by combustion and comply with the construction, chemical composition, and other requirements of the U.S. Consumer Product Safety Commission, as set forth in Title 16, Code of Federal Regulations.

It is well known, for example, to have fireworks artillery shells which include a lifting charge and an effects charge. These artillery shells are placed in an upright tube, sometimes called a mortar (see, for example, U.S. Pat. No. 6,286,429, the disclosure of which is incorporated herein by reference). A typically prior art artillery shell is shown in FIG. 1. The shell 10 has a long fuse 12 leading from the end of the tube down to the lift portion charge 14. The lift portion 14 has a paper cylinder 16 wrapped around a black powder lift charge 18. Ignition of the fuse 12 leads to ignition of the lift charge 18, which propels the shell 10 upwardly and out of the tube. The shell 10 also typically includes a timing fuse 20 to connect the lift charge to an effects portion 22 having an effects charge 24. As shown in FIG. 1, the effects portion 22 is typically provided by two paper cups 26 and 28 with a paper liner. The maker scoops the cups into a receptacle of the effects charge 24 and then pushes the two open ends of the cups together and glues the cups together. The connected cups are then wrapped in paper, and then connected to the timing fuse and lifting portion. This timing fuse 20 provides a suitable delay between the ignition of the lift charge 18 and the detonation of the effects charge 24 in order to allow the shell to reach a desired altitude. The timing fuse 20 then detonates the effects charge 24, which then produces the visual effect. Another type of artillery shell is shown in U.S. Pat. No. 6,283,033 and D429,516, the disclosures of which are incorporated herein by reference.

However, because of the amount of explosives for such fireworks is limited by regulation, the bursting effect of such prior art artillery shells has been small, especially in relation to display fireworks. As such, there has developed a need for an artillery shell which has a greater bursting presentation while still within the consumer fireworks definitions and regulations, and which is still economical to produce and sell.

SUMMARY OF THE INVENTION

These objects have largely been met by the fireworks artillery shell of the present invention. The fireworks artillery shell herein remains a consumer firework with a limited amount of total explosive, but effectively increases the burst presentation of the shell by more effective sealing of the surrounding casing for the effects charge in using a paper tube with packing material pressed into place at each end. Consequently, the effects charge is held more tightly, and upon detonation, the effects are driven more effectively and with greater audible report than was possible with prior art fireworks artillery shells which do not have effective sealing using a dense, inert sealing material to seal off the effects charge from the lifting charge and to seal the effects charge within the casing.

In broad terms, the artillery shell of the present invention includes an ignition fuse, a casing, a lifting charge, a timing fuse, and an effects charge. The casing is preferably a cylinder with sealing material sealing the effects charge within the cylinder. Preferably, the sealing material is earth, and in particular clay, which is tamped and tightly packed into place to seal and isolate the effects charge. The cylinder is preferably a paper tube which is most preferably seamless. The clay sealing material is tamped by pressing or by impact to seal tightly against the cylinder.

Upon ignition of the effects charge by the timing fuse, the effects charge detonates. Because the cylinder is sealed by the packing material, leakage of the gases from the casing is minimized. Thus, the explosive effect of the effects charge is concentrated within the casing, which ruptures as the explosive gases escape. As a result, the audible report and distance the effect particles are propelled is increased in comparison to existing fireworks artillery shells.

These and other advantages will be readily apparent to those skilled in the art with reference to the drawings and description which follow.

DESCRIPTION OF THE PREFERRED EMBODIMENT

Figure 2:
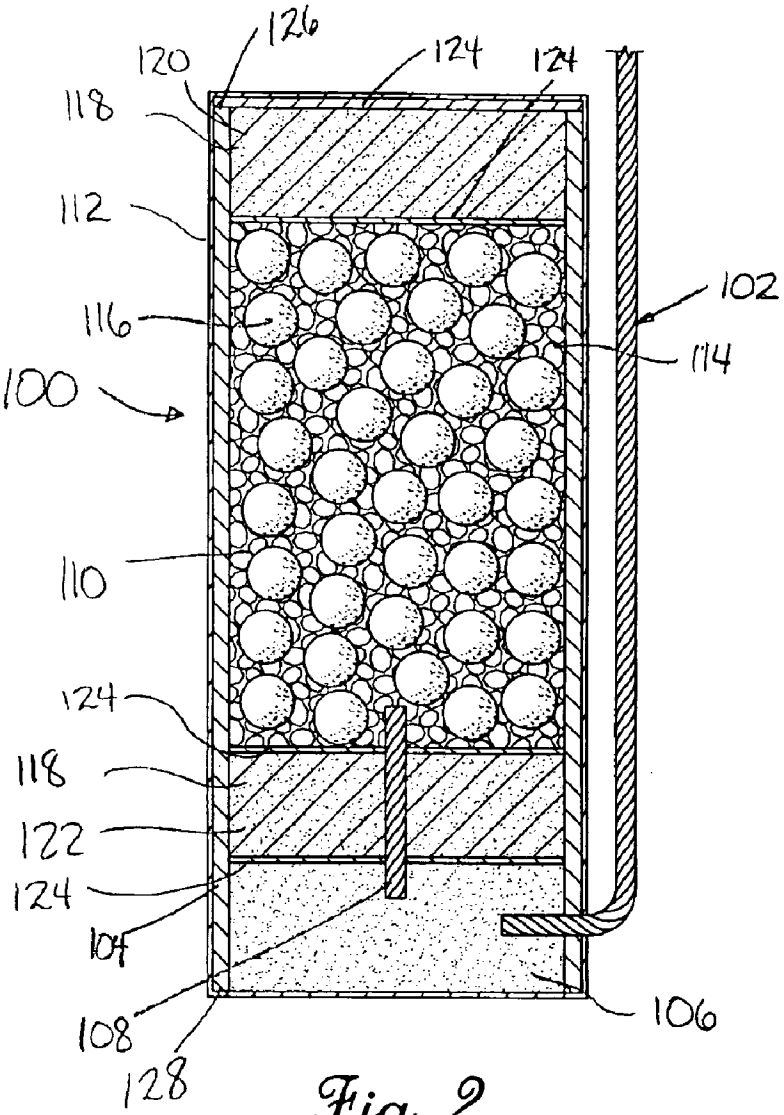
FIG. 2 is a vertical cross sectional view of the fireworks artillery shell of the present invention, wherein the casing for the effects portion of the shell is a tubular member with plugs of sealing material at each end of the tube.
Figure 1:
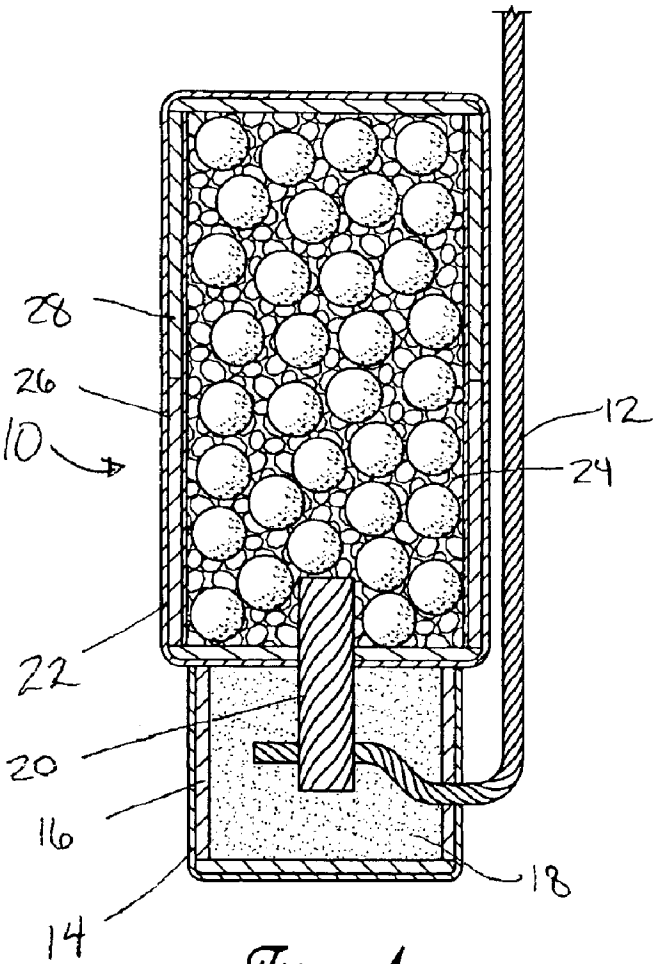
Fig. 1. PRIOR ART
FIG. 1 is a vertical cross sectional view of a prior art fireworks artillery shell, showing the casing surrounding the effects charge, the casing including two cups and a paper liner.

Referring now to FIG. 2, a fireworks artillery shell 100 in accordance with the present invention broadly includes an ignition fuse 102, a casing 104, a lift charge 106, a timing fuse 108, and an effects charge 110. A paper wrapper 112 preferably envelopes the casing 104 to provide for the receipt of identifying indicia and limited moisture resistance.

In greater detail, the ignition fuse 102 is typically of twisted paper or fabric strands covered with black powder for promoting the ignition of the fuse and of a length sufficient to extend upwardly and over the top of the mortar. The length and coating may also be varied according to the desired delay between the time the remote end 112 of the fuse is lit and the time the lifting charge is ignited.

The casing 104 is preferably a paper cylinder which is most preferably manufactured as a seamless tube with a hole at its bottom end to permit the passage of one end of the ignition fuse 102 therein. The tube is most preferably solid paperboard stock, but alternatively may be manufactured by spiral wrapping of paper in successive layers, and additional paper or paper mache may be applied or glued to the exterior of the tube to increase its strength.

The lift charge 106 is conventional and may be of different compositions as desired by the maker. One suitable lift charge 106 for a consumer fireworks artillery shell 100 as disclosed herein would typically be between about 5 and 12 grams and more typically would be about 8 grams, and may be of a black powder charge or suitable alternatives, such as a composition by weight of about 74% potassium benzoate ($KC_7H_5O_2$), 6% sulfur (S), and 20 percent carbon (C), preferably charcoal.

The timing fuse 108 is also of twisted paper or fabric material coated with black powder or the like, and typically has a greater thickness than the ignition fuse. The timing fuse 108 operatively connects the lift charge 106 to the effects charge 110, such that upon ignition of the lift charge 106, the timing fuse 108 is lit and burns upwardly to ignite and detonate the effects charge 110.

The effects charge 110 may have many different compositions as is well known to those skilled in the art. Illustrated herewith is an effects charge 110 having a bursting charge 114 and a plurality of pearl charges 116, which, after ignition, present the appearance of colored streams or stars. A suitable bursting charge 114 for a consumer fireworks artillery shell in accordance with the present invention would typically weigh between about 5 to 11 grams and would typically be about 8 grams, and have a composition by weight of about 22% potassium perchlorate ($KClO_4$), 48% potassium nitrate ($KNO_3$), 26% carbon, typically charcoal (C), and 4% powder of polished gelatinous rice. The composition of the pearl charges 116, which are typically small balls and present a colorful display when ignited, will vary according to color and are well known by those skilled in the art, but a typical effect might have a plurality of pearl charges which display a red color after ignition. A typical composition by weight for a red pearl charge 1116 would be 40% potassium perchlorate ($KClO_4$), 25% strontium carbonate ($SrCO_3$). 20% aluminum-magnesium powder alloy, 10% phenolic resin and 5% polyvinyl chloride. The pearl charges may also be colored blue, yellow, green, silver or other colors as is well known by those skilled in the art.

Sealing material 118 is provided within the casing 104 on top of and below the effects charge 110 as the fireworks artillery shell 10 is oriented in FIG. 2. The sealing material 118 is relatively incombustible and preferably provided as a relatively dry clay powder which is tamped or compressed into place into plugs. An upper seal 120 of sealing material 118 is substantially solid and imperforate. A lower seal 122 of sealing material 118 is tamped or compressed around the timing fuse 106, which passes through the lower seal 122 and extends above and below it to come in contact with the lift charge and the effects charge. Wafers 124 of paperboard are preferably positioned within the casing 104 above and below each of the seals 120 and 122 to help isolate the seals from moisture intrusion, inhibit fragmentation, and to aid in assembly. The casing 104, being substantially continuous and imperforate in the area between the upper seal 120 and the lower seal 122, has an upper end 126 and a lower end 128. The upper seal 120 extends substantially across and encloses the upper end 126, and the lifting charge extends substantially across the lower end 128.

To construct the fireworks artillery shell 100 hereof, the maker places the wafer 124 atop the cylinder of the casing 104 and then inverts it and places the clay powder in the casing, then adds the wafer positioned below the upper seal 120. The clay powder sealing material 118 is then compressed into place. One way of accomplishing this is by using a hammer and a tool with a shaft and a disc fitting into the casing. The disc of the tool has an outer diameter corresponding to the inner diameter of the casing. By several swift strokes of the hammer, the sealing material 118 is tightly packed and compressed into place against the casing 104 and, with the wafer 124 between, against the effects charge. The effects charge 10 is then placed in the casing 104 and the timing fuse 106 inserted into place. Another wafer 124 is placed in the casing, and the sealing material of the lower seal 122 is inserted into the casing, and then another wafer 124 placed atop the sealing material 118 so that wafers 124 are both above and below the lower seal 122. The hammer and tool are used again as described above to compress the powder into a tight sealing arrangement with the casing 104 and compressed toward the effects charge with the wafer 124 in between, by several hammer strokes. The lift charge 104 is then filled into the bottom end of the casing 104 and pressed into place with the timing fuse 102 passing through the casing 104 as described above and one end thereof in communication with the lift charge 106 as described. In use, the fireworks artillery shell 100 is inserted into the mortar with the lifting charge positioned lowermost as illustrated and with the ignition fuse 102 leading upwardly and over the open upper end of the mortar. The user lights the exposed end of the ignition fuse 102, retires a safe distance, and watches. The lift charge 106 burns through the paper wrapping 112 and propels the shell 100 out of the mortar and ignites the timing fuse 108. When the timing fuse in turn ignites and detonates the effects charge 10, the sealing material and casing causes and improved and more powerful explosion which more forcefully distributes the pearl charges.

It may be appreciated that various sealing materials may be employed in the present invention. For example polyurethane or other synthetic resins, glue, paste, or cement might be used instead of or in addition to the clay sealing material. Additionally, the casing might be provided of synthetic resin, such as polyvinyl chloride, instead of paper, paperboard or the like. The construction of the fireworks artillery shell 100 is simplified relative to existing shells, requiring only a single tube rather than multiple components. As a result, a simpler device is provided without significant changes in overall weight, while a stronger "break" when the effects charge is detonated is produced.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

What is claimed is:

1. A consumer fireworks artillery shell comprising:

a casing comprised of paper;

a lift charge received in the casing, wherein the weight of the lift charge is between about 5 grams and 12 grams;

an ignition fuse extending from the exterior of the casing into the lift charge whereby the ignition fuse may ignite the lift charge to propel the casing into the air;

an effects charge received in the casing, the effects charge including a bursting charge having a weight between about 5 grams and 11 grams;

a lower seal of sealing material received in the casing and in sealing engagement therewith, and positioned below the effects charge and between and separating the lift charge and the effects charge;

a timing fuse extending through the lower seal, received within the casing, and operatively connecting the lift charge and the effects charge;

an upper seal of sealing material received in the casing and in sealing engagement therewith above the effects charge and opposite the lower seal;

a paper wafer positioned between the lower seal and the effects charge;

a paper wafer positioned between the upper seal and the effects charge; and a paper wrapper substantially surrounding and enclosing said casing including said lift charge and said effects charge, said ignition fuse extending through said paper wrapper and into said casing for ignitably communicating with said lift charge;

said lower seal and upper seal being provided of a substantially incombustible material which seals against the casing.

2. A fireworks artillery shell as set forth in claim 1, wherein the casing is a cylindrical paper tube.

3. A fireworks artillery shell as set forth in claim 2, wherein the tube is substantially seamless and imperforate in the area between the upper seal and the lower seal.

4. A fireworks artillery shell as set forth in claim 2, wherein the tube has an upper end and a lower end, and the upper seal extends substantially across the upper end and the lift charge extends substantially across the lower end.

5. A fireworks artillery shell as set forth in claim 1, wherein the sealing material is clay.

* * * * *